United States Patent [19]

Jordan et al.

[11] Patent Number: 4,794,959

[45] Date of Patent: Jan. 3, 1989

[54] FILLING VALVE FOR COUNTERPRESSURE FILLING MACHINES

[75] Inventors: Heinrich Jordan; Rolf Süshardt, both of Dortmund, Fed. Rep. of Germany

[73] Assignee: Holstein und Kappert GmbH

[21] Appl. No.: 926,805

[22] Filed: Oct. 30, 1986

Related U.S. Application Data

[63] Continuation of Ser. No. 704,747, Feb. 25, 1985, abandoned.

[30] Foreign Application Priority Data

Feb. 25, 1984 [DE] Fed. Rep. of Germany ..... 3406922

[51] Int. Cl.[4] ..... B65B 31/04

[52] U.S. Cl. ..... 141/141; 141/6

[58] Field of Search ..... 141/6, 140, 141, 142, 141/143, 147, 192, 193, 207, 276, 290

[56] References Cited

U.S. PATENT DOCUMENTS

| | | | |
|---|---|---|---|
| 2,057,538 | 10/1936 | Petersen | 141/276 |
| 2,617,575 | 11/1952 | Majonnier | 141/6 |
| 3,589,410 | 6/1971 | Manas | 141/141 X |
| 4,031,930 | 6/1977 | Sutcliffe et al. | 141/207 |

*Primary Examiner*—Mark J. Thronson

*Attorney, Agent, or Firm*—Toren, McGeady & Associates

[57] ABSTRACT

In a filling valve for a counterpressure filling machine for filling containers, such as bottles, cans and the like, comprising a filling valve body including a filling channel, a centering tulip for positioning a container below the filling channel in sealed connection therewith, second channels in said valve body coacting with said filling channel for at least one of evacuating, pressurizing and relieving a container located within said second channels, wherein the improvement comprises each said auxiliary valve includes an axially elongated control bolt located in said filling valve body for opening one of said second channels, said control bolt having a first end located within said filling valve body and a second end located on the outside of said filling valve body, a cam plate located opposite the second end of said control bolt outside of said filling valve body and selectively engageable by the second end of said control bolt, and means associated with said centering tulip for cooperating with said control bolt and said cam plate when a container is present in the centering tulip for properly axially displacing said control bolt and opening the respective said second channel by axial displacement of said second end of said control bolt by said cam plate.

4 Claims, 1 Drawing Sheet

Figure 1:
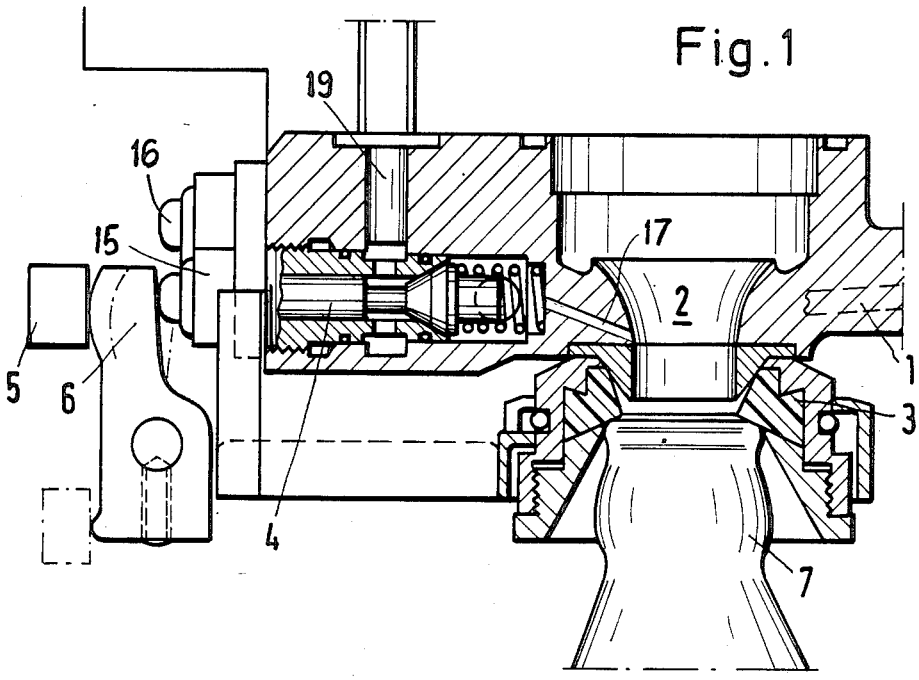

19
16
15
17
2
5
6
1
3
4
7

19
18
12,12'
10
5
17
2
8
9
3
11
14
13
7

FILLING VALVE FOR COUNTERPRESSURE FILLING MACHINES

This is a continuation of application Ser. No. 704,747, filed Feb. 25, 1985, now abandoned.

The invention is directed to a filling valve for filling of containers such as bottles, cans and such like, consisting of a filling valve body and coacting with it channels for evacuation, pressurizing and releasing as well as valves associated with the channels, which are controllable separately and/or collectively from the exterior.

Here one deals with rotating filling machines into which the bottles to be filled are fed spaced from each other, then revolve in the filling machine rotating circle and are subsequently discharged out of the filling machine. Hereby the bottles are centered by means of centering tulips immediately after transfer onto the filling machine rotation circle, they are lifted from below and moved against the filling valves. The functions of this filling element go on automatically provided a bottle is applied below the filling element, meaning the bottle is evacuated then is pressurized by means of pressurizing gas onto the kettle internal pressure and subsequently filled. In particular for a vacuum supply the filling valve comprises an additional auxiliary valve, whose control bolt protrudes towards the outside and is actuated by fixed or pivotable cam plates. These cam plates do not react to missing or damaged bottles, so that the applicable valves are actuated also in such cases, without their function being required. Hereby occasionally losses occur with filling machines of this sort depending upon their throughput performance, which must be avoided within the framework of the present invention. The invention has therefore set itself the goal to allow the valve to function only when a flawless bottle is located under the filling valve for the purpose of being filled.

This task is solved in accordance with the novelty by supporting auxiliary control segments interswitchably at the valve parts between the control bolt of the valves and the cam plate provided for the control operation.

Hereby it has shown itself to be advisable, that an auxiliary control segment is pivotably supported at the centering tulip and displaceable by same into the range of the principal cam plate between it and the control bolt.

It is also conceivable, that the control bolt can be designed to be divided and an auxiliary control element is interswitchable between its outer and its inner portion pointing towards the valve.

This auxiliary control element can be constituted within the framework of the invention by a sphere interswitchable by bolts actuatable by the centering tulip.

It is already known in the state of the art to directly initiate the function of certain valves by means of control levers attached at the centering tulip, as for instance as is shown in the DE-OS No. 1 632 014. Hereby one deals with the unloading of certain areas or with the control functions which are accomplished directly by the centering tulip.

Counter to this, the present invention has the advantage that fixed control paths exist in correspondingly stable construction, which are generally suited for the switching and control of the valves concerned, but can only function when the bottle in question is applied at the desired level below the filling element. The embodiment proposed in the present invention has the additional advantage, that normal valves can also be subsequently equipped with such a safety switching, without that special modification work has to be accomplished at the valve itself. This is important inasmuch as the filling valves concerned are extremely complicated and fabricated from high grade material.

In the following the invention is described with particularity with the help of embodiment examples depicted in the drawings.

Figure 2:
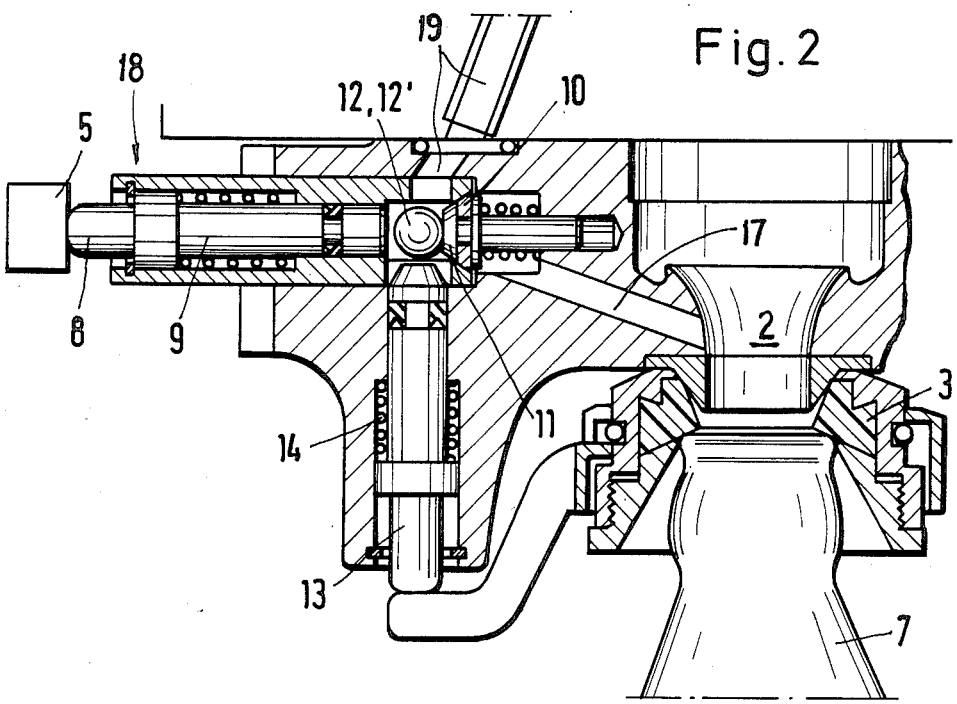

The drawings show:

FIG. 1 the filling valve in cross-section with interswitchable control part, and FIG. 2 a design of the filling valve with a divided control bolt.

The filling valve shown in FIG. 1 consists of a main valve body 1 and a channel 2 for the filing liquid. In this channel 2 a valve shutoff body, not further shown here, is supported. The main valve body 1 additionally comprises auxiliary valves, which can be provided for evacuation of the bottle as well as for its release. Additionally, a centering tulip 3 which can be moved up and down in axial direction is located below the main valve body 1, whose task it is to center the bottles supplied from the feed star into the filling machine rotation circle and to seal them against the atmosphere during the pressing-on operation at the main valve body 1. The previously mentioned control valves generally exhibit a control bolt 4 directed towards the outside, which is actuatable by a fixed cam 5. During rotation of the filling machine this cam plate 5 is retained in an applicable position, so that all control bolts sliding by it are actuated. The invention now provides that an auxiliary control segment 5 is interswitchably supported at the valve parts or such like between such a control bolt 4 and the cam plate 5 provided for the control operation, so that, if the cam plate 5 is conformally arranged spaced with respect to the front side of the control bolt 4 it can only enter into action, when an auxiliary control segment 6 is present between the inner cam plate and the control bolt 4. As can be seen from FIG. 1, it is appropriate to connect the control segment 6 with the centering tulip 3 and to render it movable up and down in axial direction according to the lifting motion of a bottle 7, meaning as soon as a flawless bottle 7 is present, it will move the centering tulip 3 in axial direction towards the top and will move the auxiliary control segment 6 into the range of the cam plate 5, which then effectuates the corresponding actuation of the control bolt 4 if the filling machine continues to rotate.

In FIG. 1 a valve can be connected to the bottle 7 via the channel 17. Another valve can be connected to the bottle to bring the pressure in the bottle up to the pressure in the filling container. Channel 19 is connected to the filling opening 2 through the channel 17 for evacuating the bottle 7.

According to the embodiment variant depicted in FIG. 2 the control bolt 8 is divided and exhibits an auxiliary control element 12 between the outer portion 9 and the portion 11 pointing to the valve 10 proper, which auxiliary control element is designed as a sphere 12 in the embodiment example and can be lifted by a control bolt 13 by means of the centering tulip 3 into the operating sequence. This occurs automatically as soon as a bottle 7 is applied below the filling element. As soon as the bottle 7 is lowered by the lifting device not shown here in detail, the bolt 13 is lowered by action of the spring 14, whereby the sphere is moved out of range of the control bolts 8, 9 and 10. If no bottle 7 is applied below the filling element, the sphere 12' does not come into range of the divided control bolts. If the outer portion 9 of the control bolt 8 is actuated by the cam plate 5 when the sphere 12' is missing, then the outer portion is displaced in direction of the filling valve, but cannot accomplish its effect, because it does not reach the valve 10 and can thus not open it. In place of the direct influencing of the control bolts concerned by portions of the filling valve proposed here, it is conceivable to provide an applicable scanning of an electric, optical or electronic sort, with which in accordance with what was previously described, an auxiliary control element is interswitched between the control bolt 4, 8 and the cam plate 5 if a flawless bottle 7 is present. This is of particular importance then, if fixed centering tulips 3 have been provided, so that their axial displacement action cannot be utilized for effecting the interswitching of the auxiliary control segment 6, 12, 12'.

In FIG. 2 an evacuation valve 18 is displayed connected by the channels 17, 19 to the filling channel 2. This arrangement operates similar to the one shown in FIG. 1 and described above.

We claim:

1. In a filling valve for a counterpressure filling machine for filling containers, such as bottles, cans and the like, comprising a filling valve body including a filling channel, a centering tulip for positioning a container below the filling channel in sealed connection therewith, second channels in said valve body coacting with said filling channel for at least one of evacuating, pressurizing and relieving a container located in said centering tulip, and auxiliary valves located within said second channels, wherein the improvement comprises each said auxiliary valve includes an axially elongated control bolt located in said filling valve body for opening one of said second channels, said control bolt having a first end located within said filling valve body and a second end located on the outside of said filling valve body, a cam plate located opposite the second end of said control bolt outside of said filling valve body and selectively engageable by the second end of said control bolt, and means associated with said centering tulip for cooperating with said control bolt and said cam plate when a container is present in the centering tulip for properly axially displacing said control bolt and opening the respective said second channel by axial displacement of said second end of said control bolt by said cam plate.

2. Filling valve as set forth in claim 1, wherein said cam plate and the second end of said control bolt are spaced apart, said means associated with said centering tulip comprises an auxiliary control segment pivotally supported at said centering tulip and displaceable into the space between said cam plate and the second end of said control bolt for operating said control bolt.

3. In a filling valve, as set forth in claim 1, wherein said control bolt comprises a first section for opening one of said second channels and a second section forming the second end of said control bolt and spaced in the axial direction of said control bolt from said first section, means selectively positionable between said first and second sections of said control bolt for effecting the opening of the one of said second channels, and said means associated with said centering tulip being engageable with said means selectively positionable between said first and second sections of said control bolt for opening said second channel.

4. In a filling valve for a counterpressure filling machine for filling containers, such as bottles, cans and the like, comprising a filling valve body including a filling channel, a centering tulip for positioning a container below the filling channel in sealed connection therewith, second channels in said valve body coacting with said filling channel for at least one of evacuating, pressurizing and relieving a container located in said centering tulip, and auxiliary valves located within said second channels, wherein the improvement comprises each said auxiliary valve includes an axially elongated control bolt located in said filling valve body for opening one of said second channels, said control bolt having a first end located within said filling valve body and a second end located on the outside of said filling valve body, a cam plate located opposite the second end of said control bolt outside of said filling valve body, and means associated with said centering tulip for cooperating with said control bolt and said cam plate when a container is present in the centering tulip for properly displacing said control bolt and opening the respective said second channel, said control bolt comprises a first section for opening one of said second channels and a second section forming the second end of said control bolt and spaced in the axial direction of said control bolt from said first section, means selectively positionable between said first and second sections of said control bolt for effecting the opening of the one of said second channels, and said means associated with said centering tulip being engageable with said means selectively positionable between said first and second sections of said control bolt for opening said second channel, said means selectively positionable between said control bolt sections comprises a spherical member, and said means associated with said centering tulip comprises a bolt engageable with said spherical member and arranged to position said spherical member between the first and second sections of said control bolt when said centering tulip positions a container below the filling channel in sealed connection therewith.

* * * * *